US006468097B1

(12) United States Patent
Bernstein et al.

(10) Patent No.: US 6,468,097 B1
(45) Date of Patent: Oct. 22, 2002

(54) ELECTRICAL DISCHARGE OF A PLUG

(75) Inventors: Elliot Bernstein, Jersey City, NJ (US); John Chen, Danville, CA (US); Robert G. Schilling, Dolgeville, NY (US)

(73) Assignee: Bel-Fuse, Inc., NJ (US)

( * ) Notice: Subject to any disclaimer, the term of this patent is extended or adjusted under 35 U.S.C. 154(b) by 0 days.

(21) Appl. No.: 09/619,060

(22) Filed: Jul. 18, 2000

Related U.S. Application Data

(60) Provisional application No. 60/144,780, filed on Jul. 20, 1999.

(51) Int. Cl.[7] ..... H01R 13/53

(52) U.S. Cl. ..... 439/181; 439/88; 439/108; 439/609; 439/676

(58) Field of Search ..... 439/181, 88, 101, 439/108, 609, 676

(56) References Cited

U.S. PATENT DOCUMENTS 4,138,711 A 2/1979 Bremenour et al.
4,568,133 A 2/1986 Amano
5,319,523 A 6/1994 Ganthier
5,730,609 A * 3/1998 Harwath ..... 439/108

FOREIGN PATENT DOCUMENTS

EP 0501749 8/1992
EP 0608814 8/1994

* cited by examiner

*Primary Examiner*—Tho D. Ta
*Assistant Examiner*—Truc Nguyen
(74) *Attorney, Agent, or Firm*—Ostrolenk, Faber, Gerb & Soffen, LLP

(57) ABSTRACT

A connector is provided with grounding contacts electrically connected to the host device's ground. The grounding contacts are positioned in the insertion path of a plug that is connected to a cable. The grounding contacts momentarily electrically contact the electrical contacts on the plug to discharge electrostatic charges in the cable to ground. A jack behind the grounding contacts in the housing receives the inserted plug. The jack includes jack contacts that are intended for making electrical contact with the plug contacts when the plug is fully inserted. Electrical connection between the plug contacts and the grounding contacts established as the plug is first inserted in the connector is broken prior to the electrical connection between the plug contacts and the jack contacts being established.

16 Claims, 3 Drawing Sheets

ELECTRICAL DISCHARGE OF A PLUG

RELATED APPLICATION

This application claims the priority of provisional U.S. application Ser. No. 60/144,780, filed on Jul. 20, 1999.

BACKGROUND OF THE INVENTION

The present invention relates to a plug and a jack system used to interconnect computer equipment or other static electricity sensitive electronic devices through the use of multiconductor cables. Often the contacts of the cable end plugs become electrostatically charged. Because the cable and the contacts of a plug may become electrostatically charged, before a plug is plugged into an electric equipment jack, e.g., at a computer port, the plug is initially inserted into and removed from an electric discharge socket which short circuits the plug contacts and discharges the contacts and the cable. Even afterward, while the plug is being inserted into the equipment or computer, additional electric charging might occur. Accordingly, there are usually further electric discharge elements, such as diodes, in the jack for further discharging the contacts and cable.

SUMMARY OF THE INVENTION

It is an object of the present invention to provide an electric equipment jack arrangement, for a computer or other static electricity sensitive equipment, that provides protection against electrostatic charge that may be transferred from a connecting cable or plug to the equipment.

Another object of the present invention is to reduce the need for internal electronic circuitry for protecting the equipment against discharge of electrostatic build-up, caused e.g., by manipulation of a cable.

Another object of the present invention is to eliminate the need for the use of a separate device for discharging the electrostatic charge of a cable prior to connection of the cable to the equipment.

The present invention concerns an improvement in a conventional connector which provides for electrical connection to a computer or other electronic device.

The connector receives a plug having a plurality of plug contacts arranged across the plug. The connector includes a jack with a plurality of jack contacts that correspond in number and positions to the plug contacts. The jack contacts are contacted by respective contacts on the plug when the plug is fully inserted in the jack.

Grounding electrical contacts reside on the jack. According to an embodiment of the present invention, just inward of the opening into the port of the connector there is a multi-tooth comb of metal grounding contacts in the insertion path of the plug contacts. Each grounding contact corresponds to and is engageable by one of the contacts of the plug as the plug is being inserted into the connector. All of the grounding contacts are grounded. For example, the grounding contacts are electrically tied to a common discharge bar. Conventionally, a grounded shield is provided around a computer housing and around the port in the computer housing. The common discharge bar may be connected to the ground by electrically connecting it to the shield.

There is usually a reasonably high resistance between the grounding contacts and the system ground, to limit peak discharge current, to prevent arcing and to suppress electrical transients, etc. It may be between the grounding bar and the shield.

The plug contacts are connected to a cable. The cable and plug may have become electrostatically charged. The arrangement provides for a momentary electrical connection between the grounding electrical contacts and the plug contacts as the plug is initially inserted into the jack, so that the electrostatic charge in the cable is shorted to the ground. As the plug is further moved toward full insertion to the end of the jack, the arrangement provides for disconnection of the plug contacts and the grounding contacts prior to initial contact between the plug contacts and the jack contacts to prevent grounding of the jack contacts which may damage the equipment.

The grounding contacts are all spring biased to interfere with movement of the plug contacts, and the plug contacts push the grounding contacts to avoid blocking plug insertion. The grounding contacts momentarily ground and simultaneously discharge the static build-up in the cable. The shape, position and motion of the grounding contacts is such that their ground connection to the plug contacts is broken before the plug contacts engage the jack contacts.

In one embodiment, the comb of a plurality of grounding contacts is secured to the base of the jack by a folded over portion of the grounded shield around the computer housing. In another embodiment, the comb of contacts is mounted to the base by projections from the base extending into corresponding locating holes in the comb.

In yet another embodiment, a coil spring is used in lieu of the multi-tooth comb, wherein the number of coils of the spring corresponds to the number of plug contacts and the placement and spacing of the coils corresponds to the placement and spacing of the contacts. The spring is connected to the grounded shield, through the above noted resistance. Accordingly, each coil of the spring momentarily short circuits its corresponding plug contact to ground as the plug is inserted into the port.

Other features and advantages of the present invention will become apparent from the following description of the invention which refers to the accompanying drawings.

DETAILED DESCRIPTION OF EMBODIMENTS OF THE INVENTION

Figure 1:
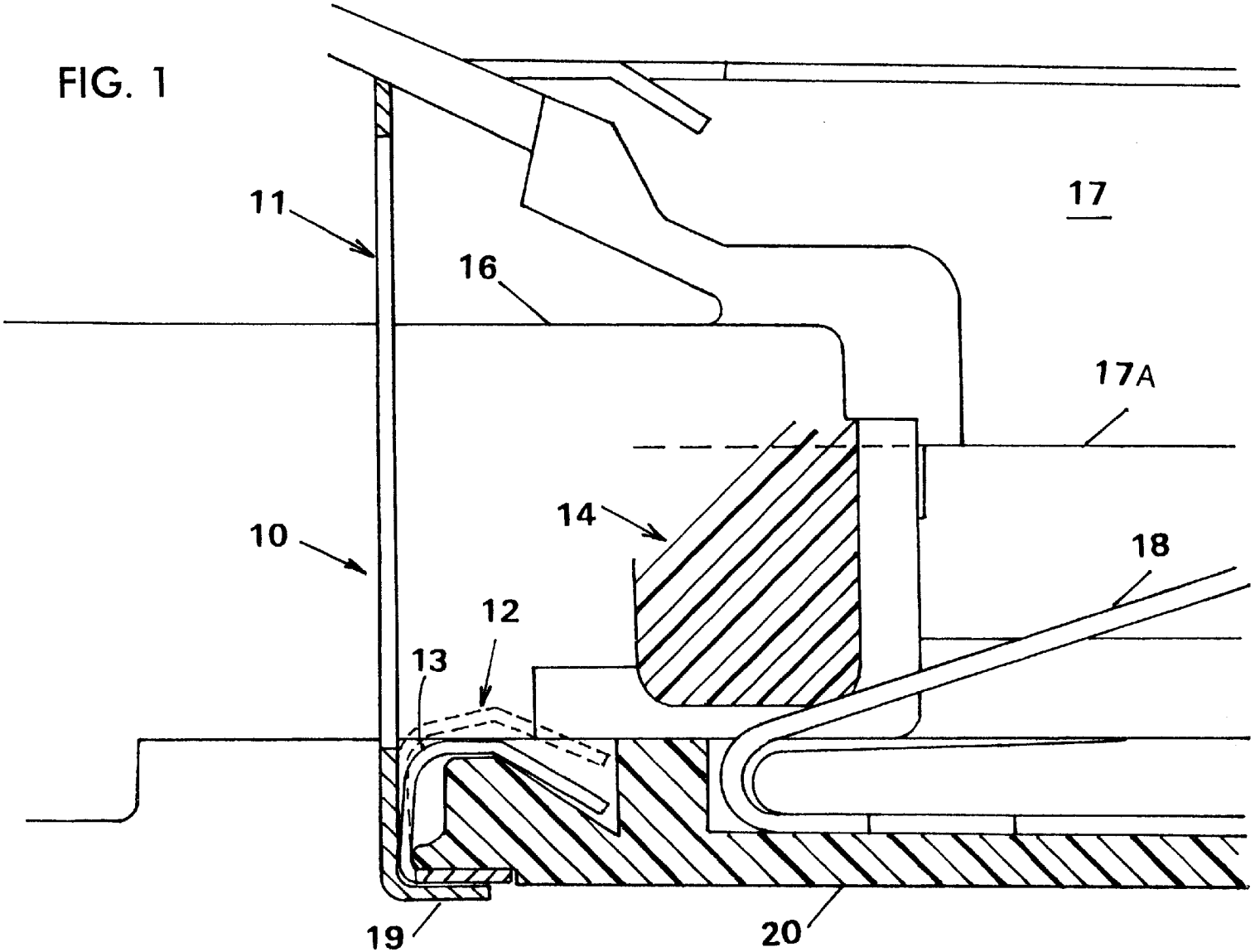
FIG. 1 is a cross sectional view of an embodiment of the present invention showing a plug inserted in a port according to the present invention.

FIG. 1 illustrates an electrical connector according to the present invention. The electrical connector has a port opening 11 and includes a jack 17. The jack 17 includes a housing 17A, and a plurality, e.g., eight, of jack contacts 18 supported inside the housing. The housing includes a base 20.

A plurality of electrically conductive grounding contacts 13 are disposed at the base 20 of the housing along the port opening 11, arranged in a row to form a multi-tooth comb 12 of grounding contacts. A shield 11, is folded over the grounding contacts 13 at the front of the base 20 to secure the contacts in place. The shield 10 is connected to ground (connection not shown). A common discharge bar 19 is electrically connected to the grounding contacts 13 and the shield 10 to ground the grounding contacts. There is a reasonably high resistance interposed between the grounding contacts 13 and the system ground. It may comprise a coating on the contacts, resistive contact material or an interposed resistive spacer between the grounding bar 19 and the contacts, for example.

FIG. 1 also shows a conventional plug 16, which is connected to a cable (not shown). The plug includes a plurality of metal plug contacts 14. The plug contacts 14 are shown in contact with respective jack contacts 18 with the plug 16 completely installed. There are the same number of plug contacts 14, jack contacts 18 and grounding contacts 13 all at the same respective positions across the jack and port. The grounding contacts 13 are spaced so that each one makes contact with a corresponding plug contact 14 when the plug 16 is inserted. The grounding contacts 13 are shown in the Figures as bent under the body of the plug 16 when the plug 16 is fully inserted. Also shown is that the plug contacts 14 are not in contact with the grounding contacts 13 because such an electrical connection may ground and possibly damage the internal circuits and components that are connected to the jack contacts 18.

The grounding contacts 13 have resilient, springy bodies to allow them to be bent down as the plug 16 is being inserted, and to return to their upraised position while the plug is being inserted and the contacts 13 and 14 engage and also when the plug is not present. The broken lines in FIG. 1 show the position of the grounding contacts 13 when the plug is not present and also when contacts 13 and 14 engage.

Operation of the connector is now described.

As the plug 16 is inserted through the port opening 11, the plug contacts 14 make electrical contact with the grounding contacts 13. Any electrostatic charge in the cable (not shown) extending back from the plug 16 is discharged, as the cable is shorted to ground through the electrical connection between the plug contacts 14, the grounding contacts 13 (a resistance) and the shield 10.

As the plug 16 is further advanced toward full insertion in the jack, the grounding contacts 13 and the plug contacts 14 disengage before the plug has been inserted far enough for the plug contacts to contact the jack contacts 18. This timing avoids grounding that may damage the internal circuits and components and also discharges the plug and the cable thereof just before they are connected to the jack.

Figure 2:
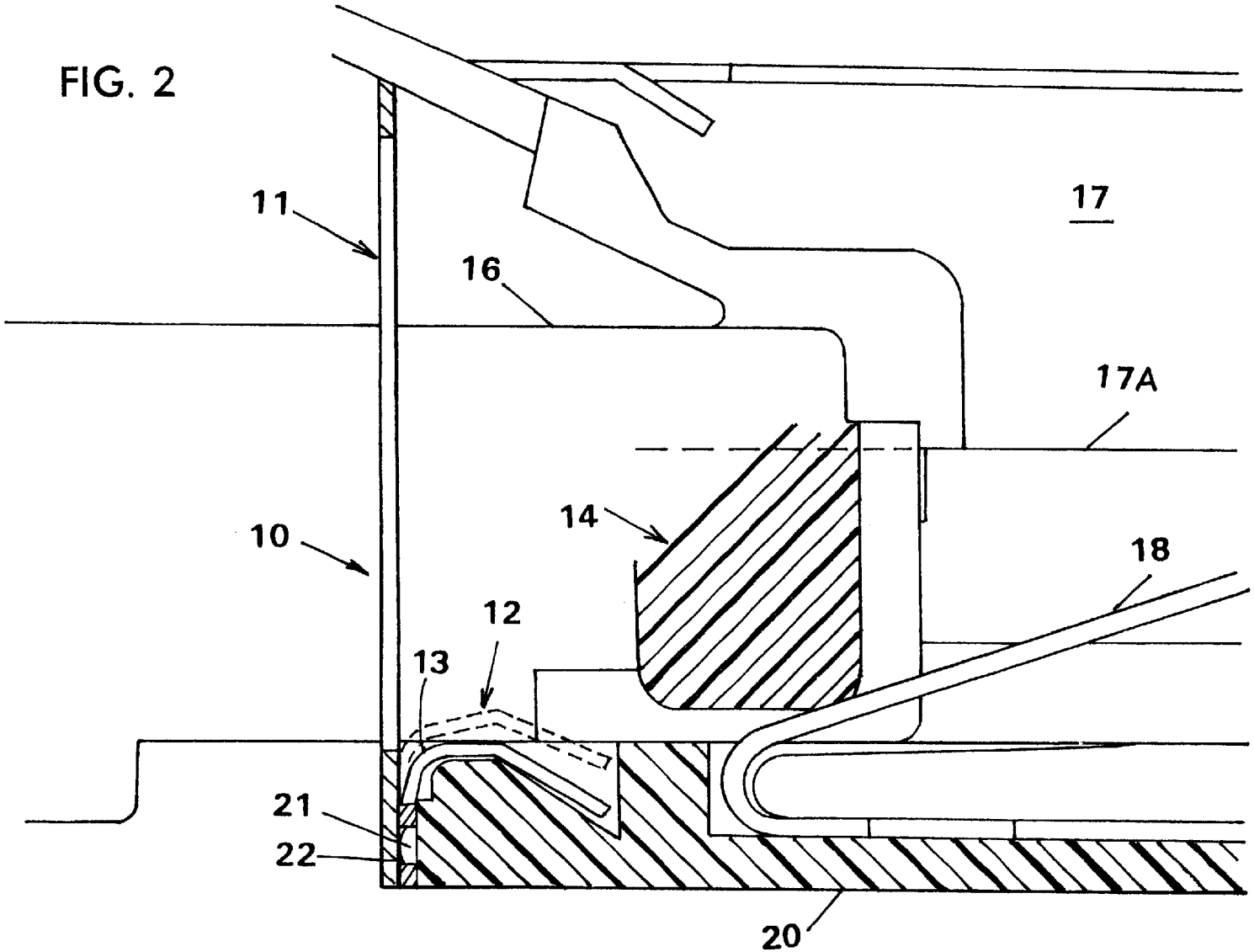
FIG. 2 is a cross sectional view of a modification of the embodiment of FIG. 1 also showing a plug inserted in a port according to the present invention.

Another embodiment of the present invention is shown in FIG. 2. FIG. 2 shows the comb 12 of contacts 13 along the frontal port opening 11 of the housing 17A and shield 10 over projections 21 (only one projection shown) on the base 20. The projections protrude through corresponding locating holes 22 (only one shown) on the comb 12. A portion of the shield 10 is shown to be on top of the comb, further securing the comb in place.

Figure 3:
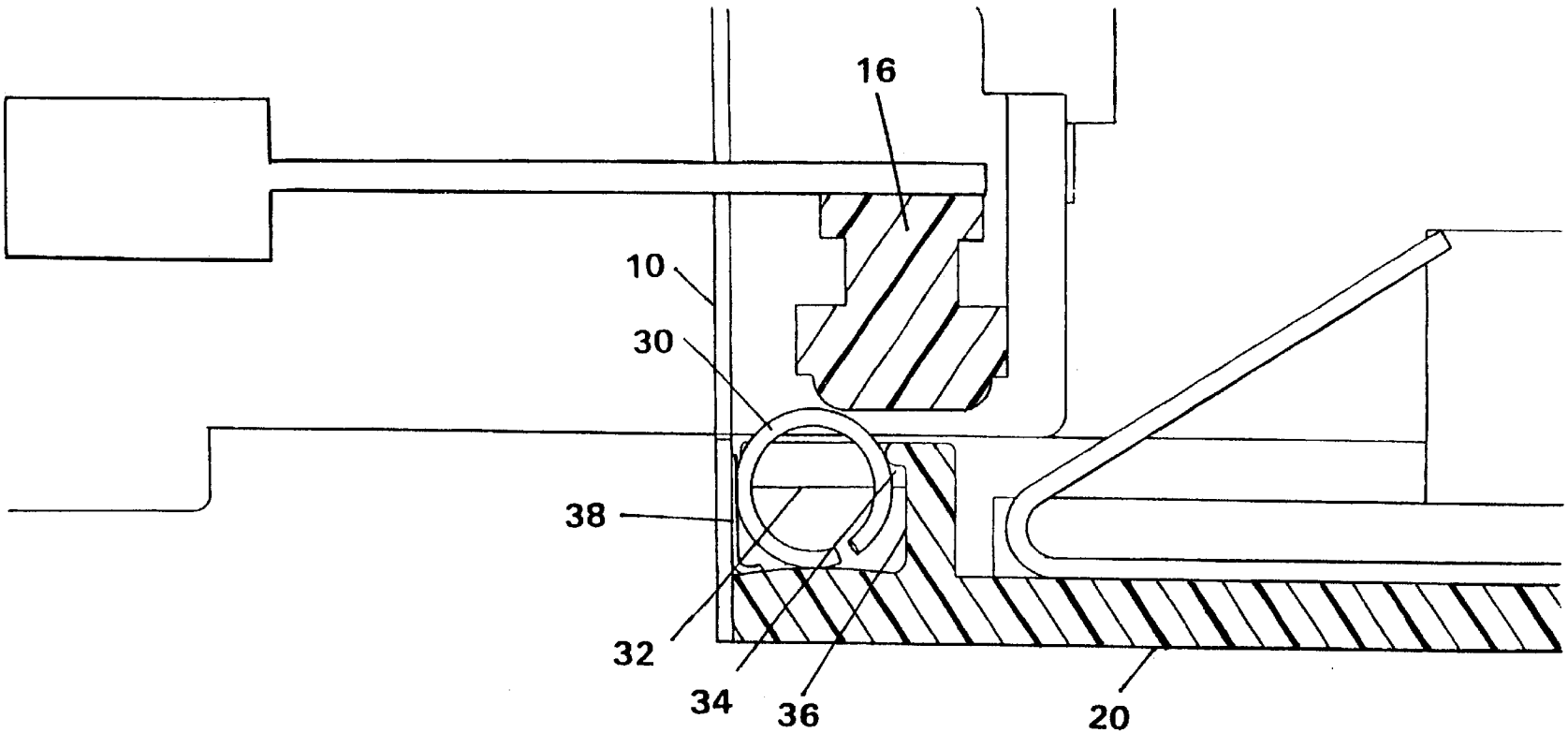
FIG. 3 is a cross section of a fragment of another embodiment.

In another connector embodiment shown in FIG. 3, a coil spring 30 may be substituted for the comb 12 of contacts. In this embodiment, the number of coils or turns of the spring may correspond to the number of metal contacts in a plug 16, and the coils or turns would be spaced so that each would contact a corresponding plug contact. The coil spring would be connected to ground. The coil comprises a fine wire helical spring to affect the transient grounding action. The helical turns are located and laterally guided by a molded comb 32 so as to present a line of arced contacts whose center lines are coincident with, and parallel to, those of the plug contacts. This alignment slightly distorts the helix so that the pitch between turns takes place primarily below the centerline of the circular coil i.e., below the comb 32.

The fineness of the spring wire and the clearance provided in the spring retention cavity allow the turns to deflect downward sufficiently to clear elements of the inserted plug and to then return to a height sufficient to touch the contacts as they pass by. A comb spine 34 traps the spring in a cavity 36 of the base 20.

FIG. 3 shows an example of a resistance between the grounding contacts of the spring 30 and the system ground at the shield 10. Here a resistive spacer pad 38 is disposed between the elements 30 and 10.

The invention herein described eliminates the need for a separate discharging step, assures minimum time lapse between cable and plug discharge and initial port contact, safeguards against the possibility of accidentally omitting the discharge step during connection and reduces the need for additional protective circuitry in the equipment using the invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical connector comprising:

an electrical jack including a housing with an interior, and a base having an outside face;

an electrical port opening into said housing;

at least one jack contact in said housing interior for making electric contact with at least one plug contact of a plug which is inserted into said jack housing; said housing having an opening for entry of said plug into said housing interior, said plug contact being insertable into electrical contact with said at least one jack contact along a linear path extending from said opening to said at least one jack contact; and at least one grounding contact supported on said housing, extending into said housing interior and positioned in the path of said at least one plug contact to electrically contact said plug contact when said plug is inserted into said jack, but before said plug is inserted sufficiently that said plug contact contacts said jack contact; said at least one grounding contact being so shaped and spaced from said at least one jack contact that said plug contact breaks contact from said grounding contact before said plug contact makes electrical contact with said at least one jack contact upon further insertion of said plug.

2. The electrical connector of claim 1, further comprising a resistance between said at least one grounding contact and a ground.

3. The electrical connector of claim 1, further comprising a shield that is connected to ground and said at least one grounding contact is connected to said shield.

4. The electrical connector of claim 1, wherein there is a plurality of said grounding contacts to engage a corresponding plurality of said plug contacts of said plug.

5. The electrical connector of claim 1, wherein said at least one grounding contact is mounted on said base and along said port opening into said jack housing.

6. The electrical connector of claim 3, further comprising a resistance between said at least one grounding contact and said shield.

7. The electrical connector of claim 3, further comprising discharge bar, said discharge bar being connected to said shield, and said at least one grounding contact is connected to said discharge bar.

8. The electrical connector of claim 7, further comprising a resistance between said grounding bar and said shield.

9. The electrical connector of claim 4, wherein each said grounding contact in said plurality of grounding contacts is a coil of a wound spring.

10. The electrical connector of claim 5, wherein a plurality of said grounding contacts are positioned to make electrical contact with a corresponding plurality of said plug contacts.

11. The electrical connector of claim 10, wherein said plurality of grounding contacts are shaped and positioned and of such material as to bend as said plug is inserted into said jack housing past said grounding contacts and to spring back when said plug is not present in said jack housing.

12. The electrical connector of claim 11, wherein said plurality of grounding contacts are mounted along said opening in said jack housing.

13. The electrical connector of claim 11, further comprising a shield folded over said grounding contacts to mount said grounding contacts onto said housing by folding part of said grounding contacts over said outside face of said jack housing.

14. The electrical connector of claim 12, wherein said mounting of said grounding contacts comprises a projection on said jack housing and a corresponding hole in said grounding contacts through which said projection protrudes.

15. An electrical connector comprising:

an electrical jack including a housing with an interior, and a base having an outside face;

an electrical port opening into said housing;

at least one jack contact in said housing interior for making electric contact with at least one plug contact of a plug which is inserted into said jack housing; said housing having an opening for entry of said plug into said housing interior; and at least one grounding contact supported on said housing, extending into said housing interior and positioned in the path of said at least one plug contact to electrically contact said plug contact when said plug is inserted into said jack, but before said plug is inserted sufficiently that said plug contact contacts said jack contact; said at least one grounding contact being so shaped and spaced from said at least one jack contact that said plug contact breaks contact from said grounding contact before said plug contact makes electrical contact with said at least one jack contact upon further insertion of said plug, wherein said at least one grounding contact is a coil of a wound spring.

16. An electrical connector comprising:

an electrical jack including a housing with an interior, and a base having an outside face;

an electrical port opening into said housing;

a plurality of jack contacts in said housing interior for making electric contact, respectively, with a plurality of plug contacts of a plug which is inserted into said jack housing; said housing having an opening for entry of said plug into said housing interior; and a plurality of grounding contacts supported on said housing, extending into said housing interior and positioned in the path of said plurality of plug contacts to electrically contact, respectively, said plug contacts when said plug is inserted into said jack, but before said plug is inserted sufficiently that said plug contact contacts said jack contact; said plurality of grounding contacts being so shaped and spaced from said jack contacts that said plug contacts break contact from respective ones of said grounding contacts before said plug contacts make electrical contact with said jack contacts upon further insertion of said plug, wherein each grounding contact is a coil of a wound spring.

* * * * *